United States Patent [19]

Fujii et al.

[11] Patent Number: 5,009,410

[45] Date of Patent: Apr. 23, 1991

[54] PAPER FEEDING SYSTEM FOR A SHREDDER

[75] Inventors: Yoshihalu Fujii, Sakurai; Yukitoshi Fujita, Yamatokoriyama, both of Japan

[73] Assignee: Sharp Kabushiki Kaisha, Osaka, Japan

[21] Appl. No.: 563,948

[22] Filed: Aug. 7, 1990

Related U.S. Application Data

[63] Continuation of Ser. No. 371,655, Jun. 20, 1989, abandoned, which is a continuation of Ser. No. 103,214, Oct. 1, 1987, abandoned.

[30] Foreign Application Priority Data

Oct. 3, 1986 [JP] Japan ..... 61-152797[U]
Jan. 13, 1987 [JP] Japan ..... 62-3755[U]

[51] Int. Cl.[5] ..... B65H 3/06
[52] U.S. Cl. ..... 271/127
[58] Field of Search ..... 271/127, 160, 161, 171

[56] References Cited

U.S. PATENT DOCUMENTS 1,395,897 11/1921 Berkowitz ..... 271/171
4,030,725 6/1977 Fukui ..... 271/171 X
4,351,519 9/1982 Jendrick ..... 271/127 X

FOREIGN PATENT DOCUMENTS 2407098 11/1979 Fed. Rep. of Germany .
2952671 9/1982 Fed. Rep. of Germany .
3422794 1/1988 Fed. Rep. of Germany .
2061231 5/1981 United Kingdom ..... 271/127

*Primary Examiner*—Richard A. Schacher

[57] ABSTRACT

A paper feeding system which comprises a paper rest rotatable around a support shaft provided on a main body; a pressure spring for pushing the paper rest to rotate toward a paper feed roller located above the paper rest; a baffle plate for preventing paper from shifting forward, provided on the main body at a position juxtapositioned to the leading end of the paper rest, with a clearance to allow the paper rest to rotate about the support shaft; paper stop ribs projecting from the surface of the baffle plate and running in the direction of the rotation of the paper rest; and notches formed in the leading end with respect to the paper feeding direction of the paper rest, permitting the ribs to interlock in the notches when the paper rest is rotated.

8 Claims, 4 Drawing Sheets

PAPER FEEDING SYSTEM FOR A SHREDDER

This application is a continuation of application Ser. No. 07/371,655 filed on June 20, 1989 which was a continuation of Ser. No. 103,214 filed on Oct. 1, 1987 both now abandoned.

BACKGROUND OF THE INVENTION

The present invention relates to a paper feeding system, and more specifically to a paper feed system for a shredder which contains a baffle plate for preventing paper from shifting forward.

The conventional shredder contains a paper rest on which to place a stack of papers, paper feeding means for supplying paper from the paper rest separately one by one, a transport block for leading the paper to a shredding cutter, and a reservoir for temporarily storing the shredded paper.

However, none of the conventional shredders has been provided with a means that effectively prevents effectively paper from clogging the paper feeding means.

SUMMARY OF THE INVENTION

In view of the above problems, the object of the present invention is to provide a paper feeding system capable of supplying paper properly and reliably.

Another object of the present invention is to provide a paper feeding system capable of rotating a paper rest accurately.

A further object of the present invention is to improve the construction of a shredder so as to prevent paper clips and other foreign matter from being sent to a cutter block and to protect the function of a paper feeding system against adverse influence by foreign matter that might be left in the paper feeding system.

Generally described, in accordance with the present invention, a paper feeding system is provided which comprises a paper rest rotatably provided around a support shaft provided on a main body, a pressure spring for pushing the paper rest to rotate toward a paper feed roller located above the paper rest, a baffle plate provided on the main body at a position opposite the end face of the paper rest, with a clearance to permit the paper rest to rotate, paper pressure ribs projecting from the surface of the baffle plate and running in the rotation direction of the paper rest, and notches formed in the leading end with respect to the paper feeding direction of the paper rest so as to allow the ribs to fit in when the paper rest rotates.

Further in accordance with the present invention, a shredder is provided having a paper rest on which to place paper to be shredded, characterized in that the paper rest is rotatable around a support shaft provided on the opposite side on the paper rest from the paper feeding side, the paper rest having such a length that when the paper rest is rotated the end face thereof faces a control plate or baffle plate with a gap of a specified width therebetween, the control plate restricting the quantity of paper to be delivered, and that a communication passage is provided to lead foreign matter dropped into the gap between the control plate and the end of the paper rest to a shred reservoir.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
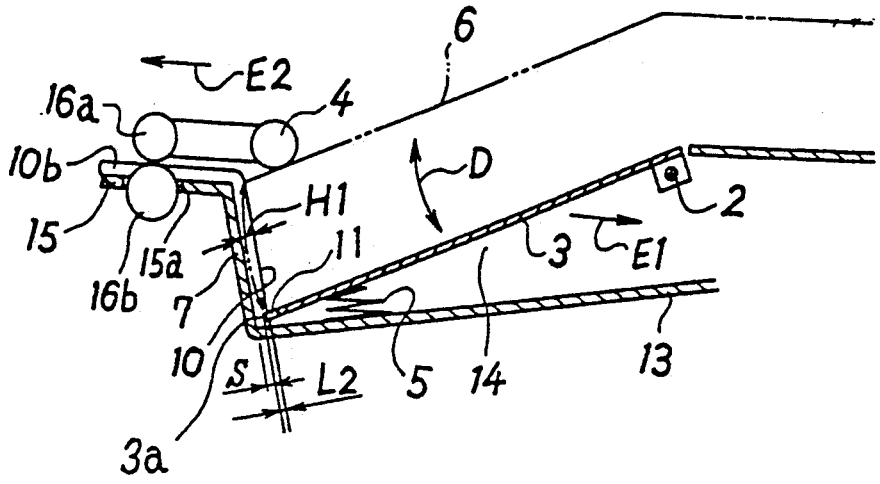
FIG. 1 is a vertical sectional side view of an essential part of a first embodiment of the paper feeding system of the present invention.
Figure 2:
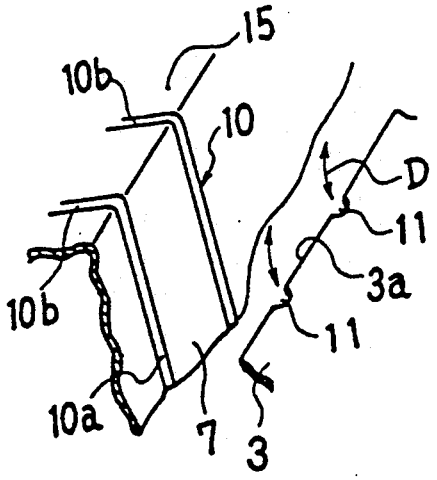
FIG. 2 is a perspective view of the essential part of FIG. 1.
Figure 3:
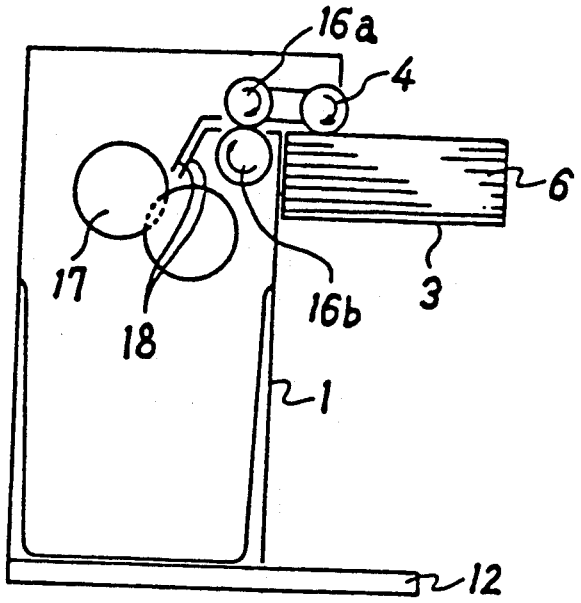
FIG. 3 shows schematically the entire construction of a shredder.

A first embodiment of the paper feeding system of the present invention will be described with reference to FIGS. 1 through 3. FIG. 1 is a vertical sectional side view of the essential part of the first embodiment of the paper feeding system of the present device. FIG. 2 is a perspective view of the essential part of FIG. 1. FIG. 3 shows schematically the entire construction of a shredder.

As shown, the present device comprises a paper rest 3 rotatable around a support shaft 2 provided on a shredder main body 1, a pressure spring 5 for pushing the paper rest 3 to rotate toward a paper feed roller 4 mounted above the paper rest 3, a baffle plate 7 for preventing paper from shifting forward provided on the main body 1 juxtapositioned to the leading end of the paper rest 3, with a clearance to allow the paper rest 3 to rotate, paper pressure ribs 10 projecting from the surface of the baffle plate 7 and running in the rotation direction "D" of the paper rest 3 and notches formed in the leading end 3*a* with respect to the paper feeding direction of the paper rest 3 to permit the ribs 11 to fit in and interlock with the notches as the paper rest 3 is rotated.

The shredder main body 1 is fixed in the manner shown in FIG. 3. An upper part of the front panel of the main body 1 serves as the baffle plate 7. A support base 13 extends, a shown in FIG. 1, from the lower end of the baffle plate 7 in the direction "E1" opposite from the paper feeding direction. The paper rest 3 is located over the support base 13 with the pressure spring 5 (compression spring) mounted therebetween. The paper rest 3 rotates within the open space 14 defined by the baffle plate 7 and the support base 13.

A parallel paper guiding plate 15 extends from the upper end of the baffle plate 7 in the paper feeding direction "E2".

The paper feed roller 4 is mounted above the leading end 3*a* of the paper rest 3. Transport rollers 16*a* and 16*b* are vertically arranged in a pair on the paper feeding side "E2" of the paper feed roller 4. The upper half of the lower transport roller 16*b* of the pair projects above the parallel guiding plate 15. As shown in FIG. 3, a cutter 17 comprising a pair of cutter rollers is arranged on the paper feeding side "E2" of the transport rollers 16*a* and 16*b*, and a pair of guide plates 18 are arranged one over the other, parallel to each other, between the transport rollers 16*a* and 16*b* and the cutter 17 so as to lead or direct the paper 6 to the cutter 17.

The ribs 10 constitute a pair of rails vertically arranged in parallel to each other on the baffle plate 7. In continuation with the ribs 10, horizontal ribs 10*b* are formed on the paper guiding plate 15.

The notches 11 are formed as pairs in the leading end 3*a* of the paper rest 3 at positions corresponding to those of the ribs 10 on the baffle plate 7. The shape of the notches 11 is the same as the cross section of the ribs 10 so that the ribs 10 fit in the notches 11 when paper is being fed.

In operation, when paper 6 is set on the paper rest 3, the weight of the paper causes the paper rest 3 to be lowered so that the paper rest 3 rotates counterclockwise about the support shaft 2. When the paper 6 is released from the hand during this state, the pressure spring 5 presses the paper 6 against the paper feed roller 4, retaining the paper 6 at a specified paper feeding level.

As paper 6 is being supplied successively and the height of the stack of paper decreases gradually, the weight of the paper is reduced, resulting in a smaller load on the pressure spring 5. Eventually, the paper rest 3 rotates clockwise about the support shaft 2, thereby retaining the paper 6 at a constant paper feeding level.

When the paper rest 3 is rotating around the support shaft 2, the leading end 3*a* of the paper rest 3 moves in an arc with the notches 11 being engaged with the ribs 10. Accordingly, a minus clearance indicated by "L2" in FIG. 1 results between the top of the ribs 10 and the leading end 3*a* of the paper rest 3 namely, the leading end 3*a* extends beyond the ribs 10 toward the paper feeding side "E2". Therefore, the end 6*a* of the paper 6 moves up as they contact the ribs 10. Accordingly, the paper will not slip off the paper rest 3 and the ends 6*a* of the paper 6, if curled down, will not be positioned between the baffle plate 7 and the leading end 3*a* of the paper rest 3. Thus, the paper 6 is supplied by the paper feed roller 4 through the horizontal ribs 10*b* to the cutter 17. Since the paper 6 makes a point contact with the ribs 10, the paper rest 3 is rotated smoothly, ensuring that the compression force of the pressure spring is transmitted accurately to the paper 6.

It is not the intention that the present invention be limited by the description of the above embodiment. Various modifications and variations may be made without departing the scope of the present device.

Thus, according to the first embodiment of the present invention, the pressure spring 5 presses the paper 6 against the paper feed roller 4, helping the paper 6 to be supplied in a good condition.

Since the ribs 10 fit in the notches 11 formed in the leading end 3*a* of the paper rest 3 as the paper rest 3 rotates, paper 6 will not slip off the paper rest 3, and the ends of paper 6, if curled down, are blocked by the ribs 10 and do not come in contact with the baffle plate 7. Accordingly, the paper rest 3 can be rotated smoothly and accurately without being interfered with by the obstacle of the paper 6 between the baffle plate 7 and the leading end 3*a* of the paper rest 3.

As understood from the above, according to the first embodiment of the invention, the pressure spring presses the paper against the paper feed roller, allowing papers to be supplied in a good condition. In addition, since the ribs fit in the notches formed in the leading end of the paper rest when the paper rest is rotated, if paper is about to slip off the paper rest or if paper on the paper rest curls down, the paper makes a point contact with the ribs, not being allowed to contact the baffle plate. Consequently, the paper will never enter the gap between the baffle plate and the leading end of the paper rest to interfere with the rotating movement of the paper rest. As a result, the paper rest can be moved stably and accurately.

Figure 4:
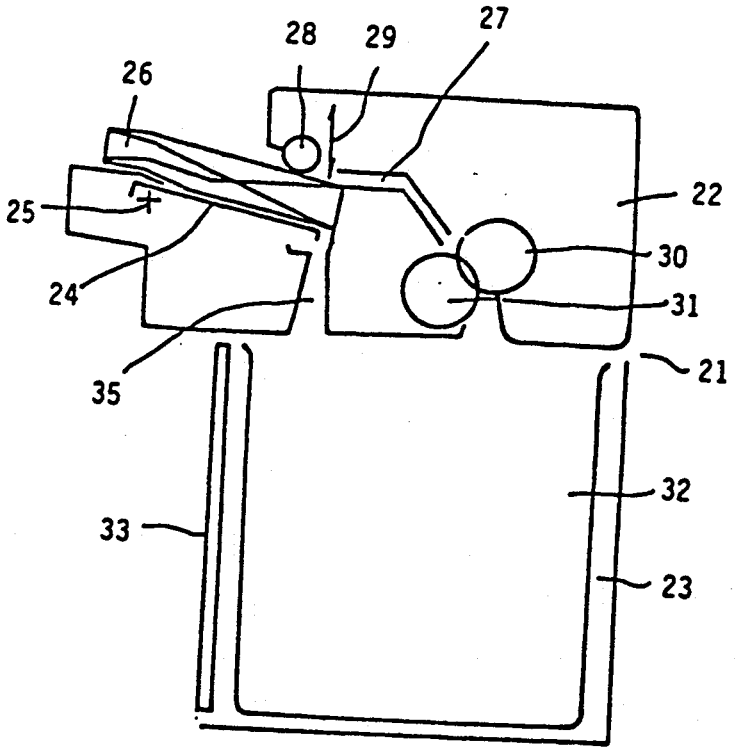
FIG. 4 shows the entire construction of the shredder related to a second embodiment of the present invention.

FIG. 4 shows the construction of the shredder related to a second embodiment of the present invention.

Referring to FIG. 4, a shredder main body 21 is composed of an upper body 22 in which papers are shredded, and a lower body 23 for storing shreds temporarily.

The upper body 22 contains a station (paper rest) 24 on which documents to be disposed of are set. The station 24 is controlled to be positioned at a specified level in relation to the paper feeding level zone.

Specifically, the paper set station 24 is rotatable around a support shaft 25, so that when paper 26 is set on the station 24, the station 24 rotates, making it possible to send the upper part of the paper 26 to a transport guide 27.

A level detector switch 29 is provided on the side of paper feed rollers 28 to detect the top level of the paper 26 set on the station 24.

The paper set station 24 is rotated by an appropriate mechanism (not shown) according to the output from the level detector switch 29. As a result, a part of the paper on the station 24 is shifted to the paper feeding level zone.

Paper thus shifted to the paper feeding level zone is carried by the rotating paper feed rollers 28 and led through the transport guide 27 to the cutter rollers 30 and 31. The papers are then cut into pieces by the cutter rollers 30 and 31 and stored temporarily in a container box 32 mounted in the lower body 23 of the shredder main body at a position under the cutter rollers 30 and 31.

The lower body 23 has a door 33 in the front panel. The door 33 is opened occasionally to take out the container box 32 and dispose of the waste shreds.

As mentioned above, the paper set station 24, when papers are set on it, rotates around the support shaft 25 and inclines. Consequently, the paper 26 on the station 24 are shifted so that the front side of the paper 26 contact with a control plate 34. In other words, the front side of the paper 26 is regulated by the control plate 34.

As the quantity of papers set on the station 24 increases, the station 24 rotates around the support shaft 25 by a larger angle and therefore inclines at a larger angle. Since the station 24 with no paper on it has been set to be horizontal, the initial position of the station 24 is such that the leading end with respect to the paper feeding direction is always lower than the trailing end, as long as papers are on it.

Naturally, foreign matter on the paper set station 24 slip off the station 24 and drop into a gap between the station 24 and a control plate (not shown) and through a communication passage 35 into the container box (shred reservoir) 32.

As described above, the control plate 34 controls the quantity of paper 26 supplied from the station 24. The paper set station 24 is rotatable around the support shaft 25 provided on the opposite side of the station 24 from the control panel 34, that is, from the paper feeding side.

Figure 5:
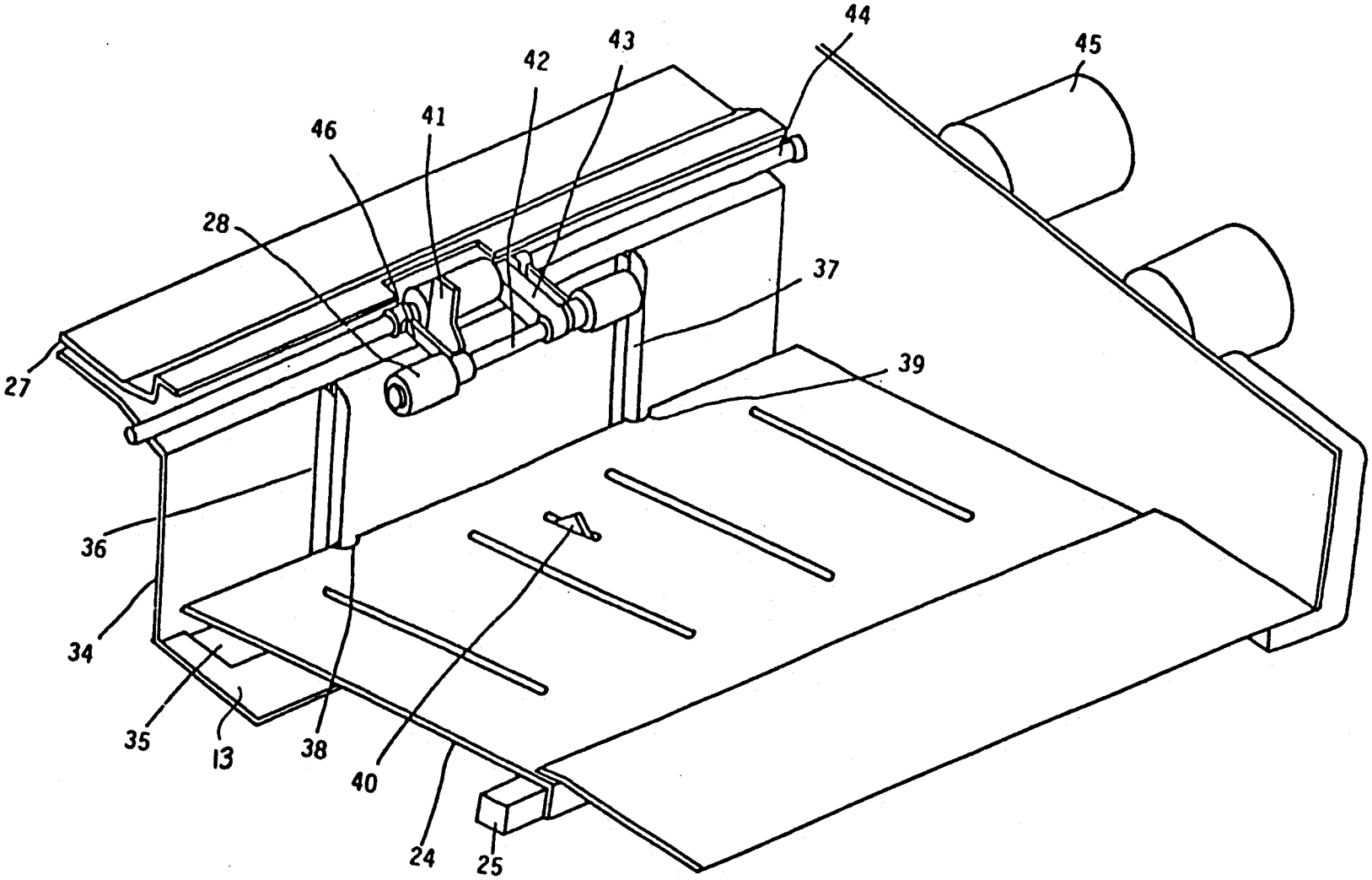
FIG. 5 is a perspective view of the paper feeding section of the shredder of FIG. 4.
Figure 6:
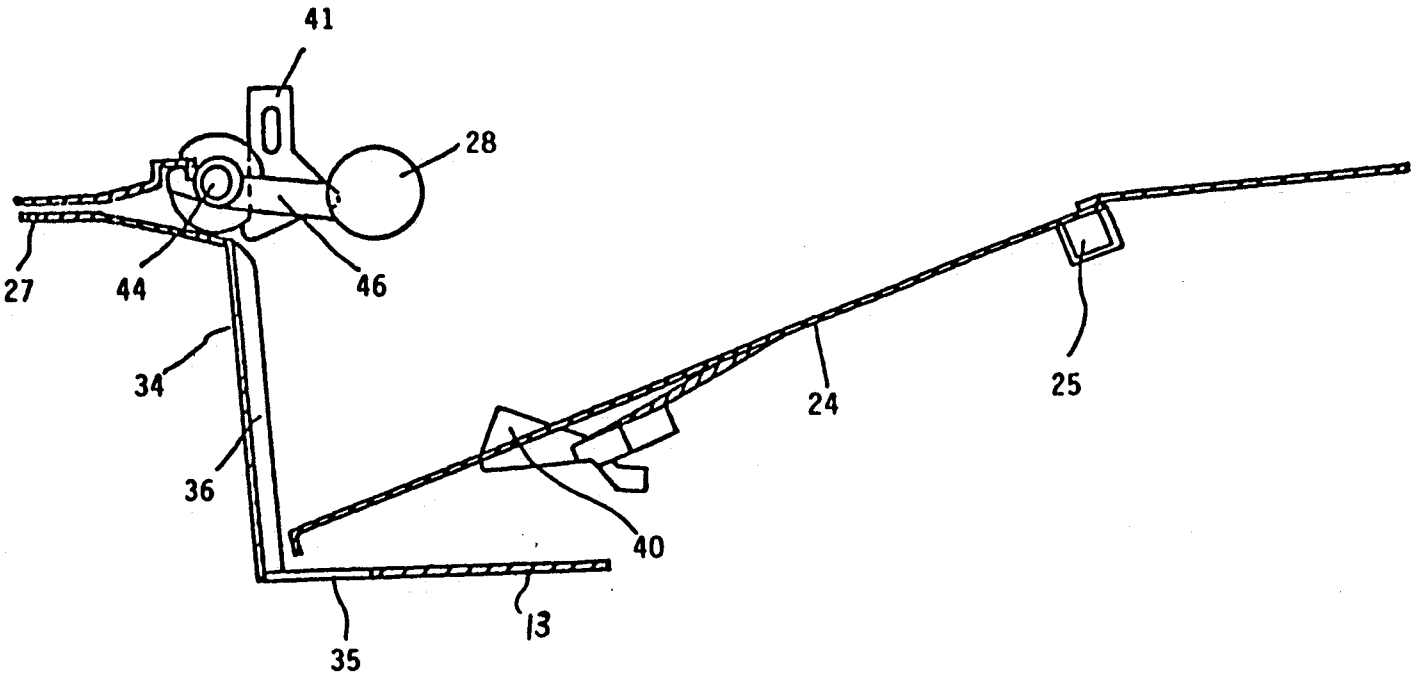
FIG. 6 is a side view of the paper feeding section of the shredder of FIG. 4.

The paper feeding section of the shredder of this embodiment is shown in detail in FIGS. 5 and 6. The same parts as shown in FIG. 4 are allotted with the same reference numbers.

As shown, the paper set station 24 is fixed on its one end to the support shaft 25. The station 24 has such a length that when it rotates around the support shaft 25 and inclines, the other end of the station 24 faces the control plate 34 (baffle plate 7 in FIG. 1) with a specified distance therebetween.

Two ribs 36 and 37 project from the surface of the control plate 34 so that the front face of the papers set on the station 24 is regulated by the ribs 36 and 37.

Notches 38 and 39 are formed in the leading end of the station 24 at positions corresponding to those of the ribs 36 and 37, preventing the leading end of the station 24 from contacting with the ribs 36 and 37.

Although the paper set on the station 24 shift toward the control plate 34 as the station rotates 24, the paper is hedged by the ribs 36 and 37, so that the leading ends (facing the control plate 34) of the papers can never enter the communication passage 35 of the support base 13.

An actuator 40 detects paper on the paper set station 24 and another actuator 41 detects the top level of the paper on the station 24.

The paper feed rollers 28 are fixed on a rod 42, to which the rotation force of a rotary shaft 44 is transmitted through a belt 43.

The rotary shaft 44 is rotated by a synchronous motor 45 which is connected to the rotary shaft 44 via a reduction gear mechanism (not shown).

The rod 42 is connected with the rotary shaft 44 by arms 46 that are independent of the rotation of the rotary shaft 44.

According to the second embodiment of the present invention, as understood from the above, in a shredder containing a paper rest on which to place a stack of waste papers, the paper rest is rotatable around a support shaft provided on the opposite side of the paper rest from the paper feeding side and has such a length that, when the paper rest is inclined by rotation, the leading end thereof faces a control plate restricting the quantity of paper to be supplied, with a specified gap therebetween. A communication passage is provided, to lead, foreign matter dropping into the gap between the control plate and the leading end of the paper rest to a shred reservoir. Accordingly, paper clips and other foreign matter left on the paper rest are not carried to the cutter block but collected in the shred reservoir. Thus, the present device eliminates the conventional troubles that foreign matter clogs the paper transport passage and damages the cutter edges.

While only certain embodiments of the present invention have been described, it will be apparent to those skilled in the art that various changes and modifications may be made therein without departing from the spirit and scope of the present invention as claimed.

What is claimed is:

1. A paper feeding system for a paper shredder comprising: a paper rest rotatably provided around a support shaft of a main body for supporting paper to be shredded; a paper feed roller located above said paper rest; a baffle plate provided on said main body at a position juxtapositioned to a leading end face of said paper rest for preventing paper from shifting forward, there being provided a clearance between said end face and said baffle plate to allow said paper rest to rotate freely around said support shaft; paper stop ribs projecting from the surface of said baffle plate, running in the direction of rotation of said paper rest; and notches formed in said leading end of said paper rest with respect to the paper feeding direction of said paper rest corresponding to each of said paper stop ribs on said baffle plate, permitting said ribs to interlock with said notches when said paper rest is rotated.

2. The paper feeding system of claim 1, wherein said ribs make contact with said paper to be shredded when said paper rest rotates.

3. The paper feeding system of claim 1, wherein said baffle plate further includes a support base portion which extends from a lower end of said baffle plate in a direction towards said support shaft of said paper rest, and a biasing means positioned between said base portion and said paper rest.

4. The paper feeding system of claim 3, wherein said base portion further includes a communication passage therein to permit foreign matter to pass therethrough.

5. The paper feeding system of claim 3, wherein said biasing means is a pressure spring.

6. A shredder having a paper rest on which to place papers to be shredded, comprising:

said paper rest being rotatable around a support shaft provided on the opposite side of said paper rest from the paper feeding side;

said paper rest having such a length that, when said paper rest is rotated, the leading end thereof faces a control plate, with a gap of a specified width therebetween;

said control plate restricting the quantity of paper to be supplied; and a communication passage provided to lead foreign matters dropping into said gap between the control plate and the leading end of the paper rest to a shred reservoir.

7. The shredder of claim 6, wherein said control plate is provided with ribs for regulating the front side of papers to be shredded.

8. The shredder of claim 7, wherein said paper rest is provided with cut-away portion means at a position corresponding to the position of said ribs.

* * * * *